US010359167B2

(12) United States Patent
Iwasaki

(10) Patent No.: US 10,359,167 B2
(45) Date of Patent: Jul. 23, 2019

(54) VEHICULAR LIGHTING

(71) Applicant: Ichikoh Industries, Ltd., Isehara-shi (JP)

(72) Inventor: Kazunori Iwasaki, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 16/075,424

(22) PCT Filed: Feb. 3, 2017

(86) PCT No.: PCT/JP2017/004056
§ 371 (c)(1),
(2) Date: Aug. 3, 2018

(87) PCT Pub. No.: WO2017/135435
PCT Pub. Date: Aug. 10, 2017

(65) Prior Publication Data

US 2019/0041021 A1 Feb. 7, 2019

(30) Foreign Application Priority Data

Feb. 4, 2016 (JP) ..... 2016-019572

(51) Int. Cl.
*F21S 41/00* (2018.01)
*F21S 41/67* (2018.01)
(Continued)

(52) U.S. Cl.
CPC ..... *F21S 41/67* (2018.01); *F21S 41/00* (2018.01); *F21S 41/141* (2018.01); *F21S 41/25* (2018.01);
(Continued)

(58) Field of Classification Search
CPC .. F21S 41/67; F21S 41/32; F21S 41/68; F21S 41/25; F21S 41/141; F21S 41/00; F21S 43/00
See application file for complete search history.

(56) References Cited

U.S. PATENT DOCUMENTS

2008/0253141 A1* 10/2008 Nakada ..... F21S 41/147 362/507
2009/0154185 A1* 6/2009 Yagi ..... F21V 5/08 362/516
(Continued)

FOREIGN PATENT DOCUMENTS

JP 2008-262755 A 10/2008
JP 2014-157733 A 8/2014
JP 2016-213023 A 12/2016

OTHER PUBLICATIONS

International Search Report dated May 9, 2017, in PCT/JP2017/004056, filed Feb. 3, 2017.

*Primary Examiner* — Donald L Raleigh
(74) *Attorney, Agent, or Firm* — Oblon, McClelland, Maier & Neustadt, L.L.P.

(57) ABSTRACT

The objective of the invention is to provide vehicular lighting such that unevenness in the light distribution occurring on a road surface is minimized upon consideration of workability when performing an adjustment by aiming, or the like. This vehicular lighting forms a light distribution having a cut-off line CL, and comprises a light source (30) and a lens (50) disposed on the forward side of the light source (30). The entry surface (51) of the lens (50) wherefrom light from the light source (30) enters comprises: an upper side entry surface (54) on an upper side from the center of the entry surface (51), wherein first light diffusing portions (54*a*) for diffusing the light are disposed; a lower side entry surface (56) on a lower side from the center of the
(Continued)

entry surface (51), wherein second light diffusing portions (56) for diffusing the light are disposed; and a middle entry surface (55) including the center of the entry surface, wherein third light diffusing portions (55*b*) and fourth light diffusing portions (55*a*) for diffusing the light are disposed, and having straight-through portions (55*c*) wherein no third light diffusing portions (55*b*) and no fourth light diffusing portions (55*a*) are disposed. The light diffusion width for each of the third light diffusing portions (55*b*) is larger than the light diffusion width for each of the fourth light diffusing portions (55*a*).

9 Claims, 6 Drawing Sheets

(51) Int. Cl.
*F21S 43/00* (2018.01)
*F21S 41/25* (2018.01)
*F21S 41/68* (2018.01)
*F21S 41/141* (2018.01)
*F21S 41/32* (2018.01)

(52) U.S. Cl.
CPC ..... *F21S 41/32* (2018.01); *F21S 41/68* (2018.01); *F21S 43/00* (2018.01)

(56) References Cited

U.S. PATENT DOCUMENTS

2014/0175978 A1* 6/2014 Kobayashi ..... B60Q 1/1423 315/82
2017/0261172 A1* 9/2017 Horiba ..... F21S 41/00

* cited by examiner

[FIG. 1]
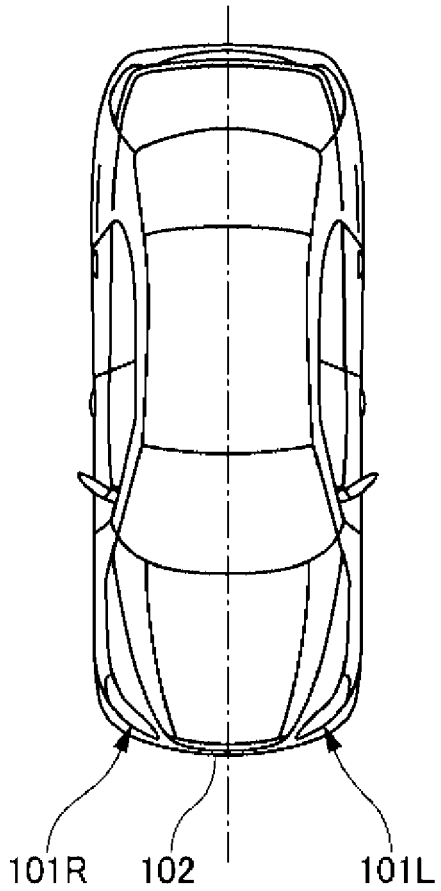

[FIG. 2]
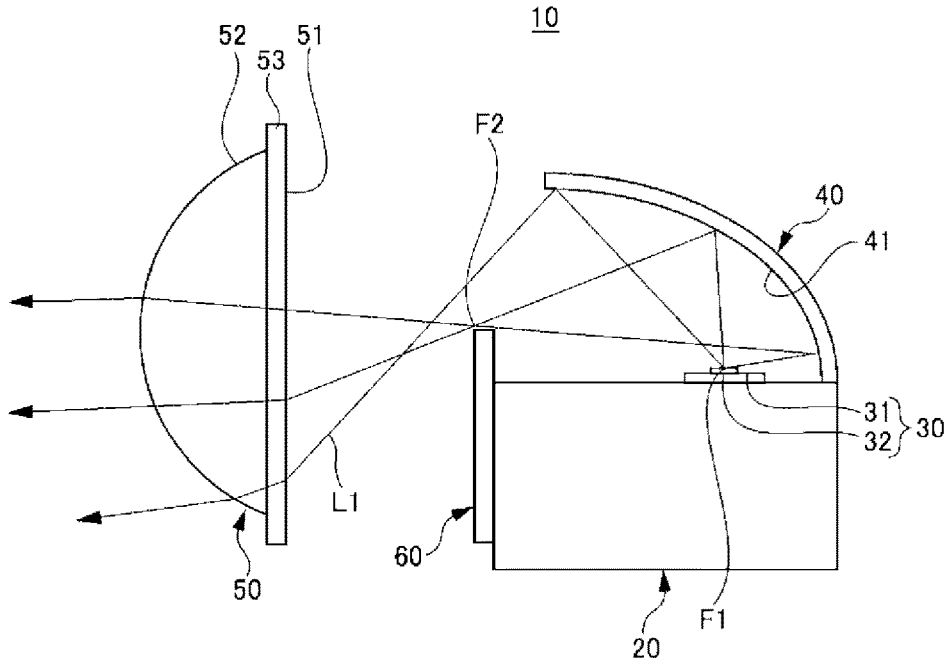
[FIG. 3]
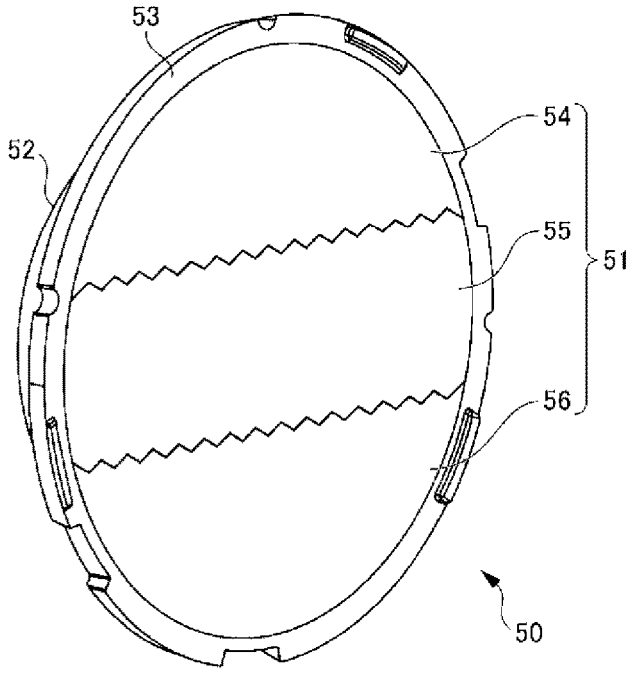

[FIG. 4]
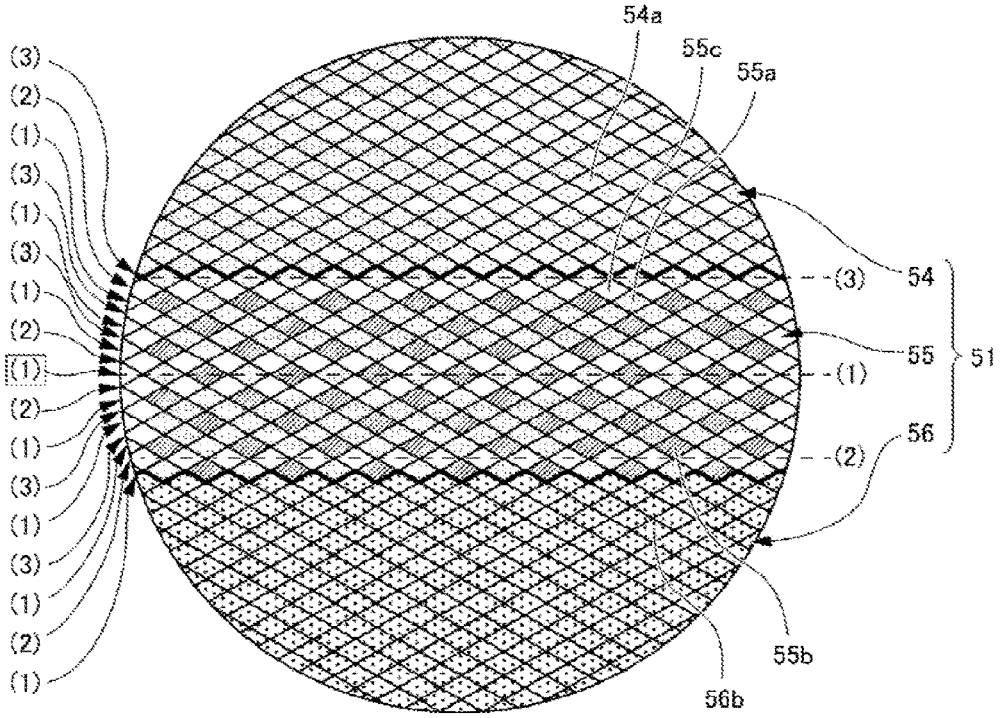

[FIG. 5]
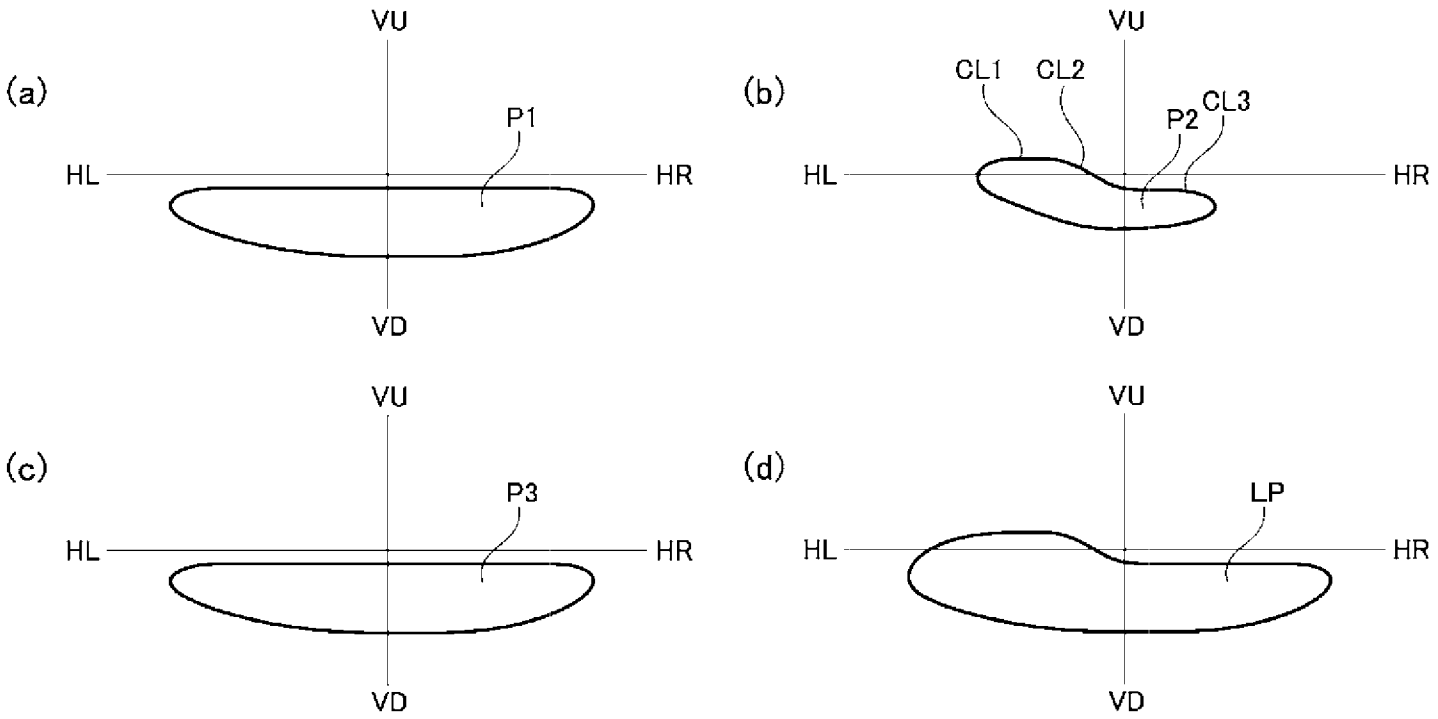

[FIG. 6]
(a)
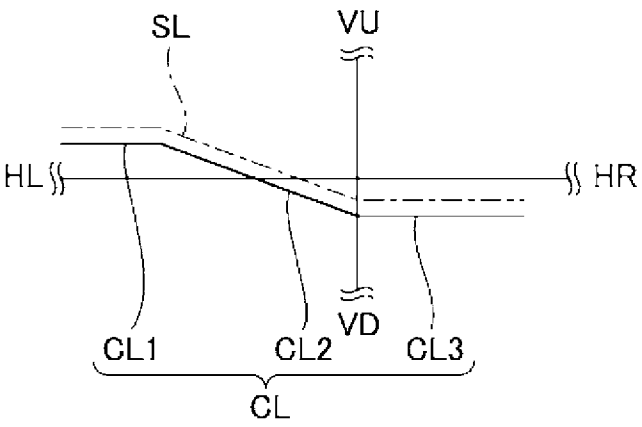
(b)
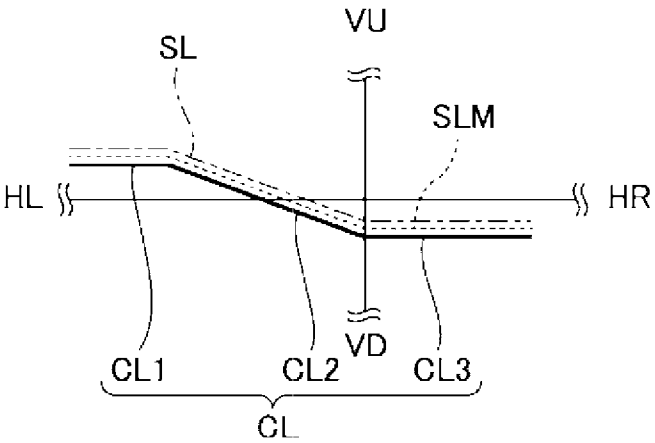

[FIG. 7]
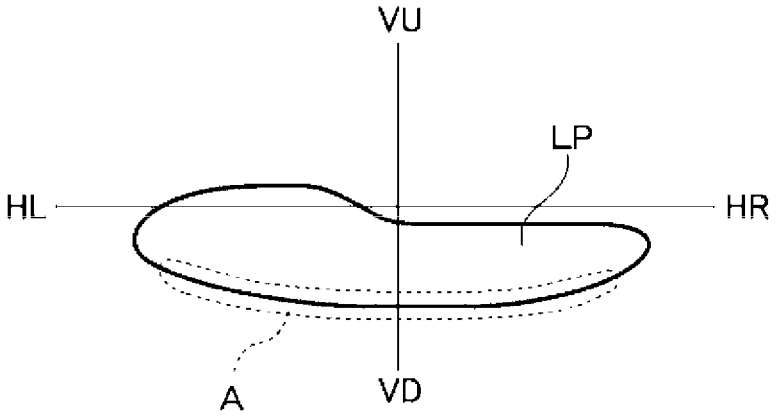
[FIG. 8]
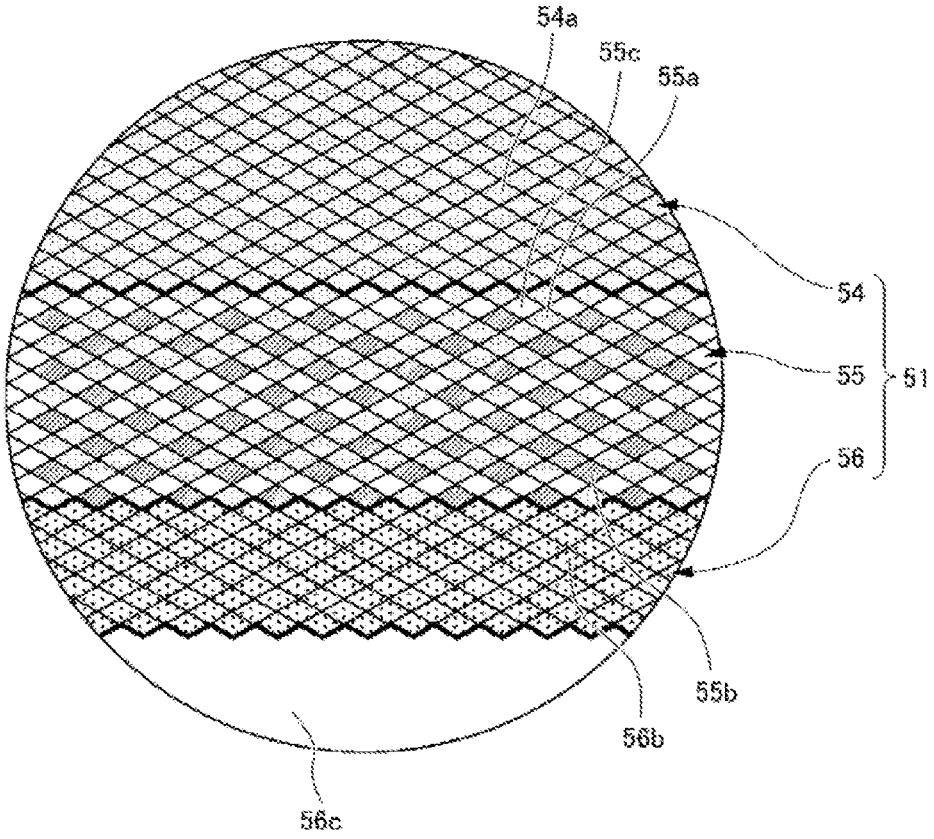

VEHICULAR LIGHTING

TECHNICAL FIELD

The present invention relates to a vehicular lighting.

BACKGROUND ART

In a vehicular lighting in which light from semiconductor light-emitting elements is vertically diffused by a vertical diffusion part when entering an incident surface of a projection lens and a cut-off line in a light distribution pattern is vertically diffused and dimmed for the purpose of improving visibility of a driver, optical streaks (optical spots) are sometimes formed on a road surface.

To solve such a problem, Patent Literature 1 discloses a vehicular lighting that includes a light source and a lens that externally irradiates light from the light source as a light distribution pattern having a cut-off line. A diffusion part for diffusing incident light is formed on an incident surface of the lens. The diffusion part is formed by crossing continuous minute concave curved surfaces or minute convex curved surfaces (see Patent Literature 1).

In the vehicular lighting disclosed in Patent Literature 1, the diffusion parts are formed on the entire incident surface (the entire surface corresponding to the range contributing to forming a light distribution pattern) of the lens without any gaps.

CITATION LIST

Patent Literature

Patent Literature 1: Japanese Unexamined Patent Application Publication No. 2014-157733

SUMMARY OF THE INVENTION

Problems to be Solved by the Invention

A cut-off line is dimmed and thus it is possible to prevent an area above the cut-off line from suddenly becoming dark as described in Patent Literature 1, which leads to an improvement in driver's visibility. However, it is difficult to view the cut-off line itself and operability in adjusting a vehicular lighting by aiming or the like is degraded.

The present invention has been achieved in view of the above problems, and an object of the invention is to provide a vehicular lighting that prevents light distribution unevenness from being generated on a road surface in view of operability of adjustment by aiming or the like.

Means for Solving the Problem (1) A vehicular lighting according to the present invention includes: a light source; and a lens disposed on a front side of the light source, the vehicular lighting forming light distribution having a cut-off line, wherein an incident surface of the lens that light from the light source enters includes an upper incident surface above a center of the incident surface, on which a first light diffusion part diffusing the light is arranged, a lower incident surface below the center of the incident surface, on which a second light diffusion part diffusing the light is arranged, and an intermediate incident surface including the center of the incident surface, on which a third light diffusion part and a fourth light diffusion part that diffuse the light are arranged, the intermediate incident surface having a plain part in which the third light diffusion part and the fourth light diffusion part are not arranged, and wherein a diffusion width of the light of the third light diffusion part is larger than a diffusion width of the light of the fourth light diffusion part.

(2) In the structure of above (1), a diffusion width of the light of the first light diffusion part is substantially equal to the diffusion width of the light of the fourth light diffusion part.

(3) In the structure of above (1) or (2), the diffusion width of the light of the third light diffusion part is substantially equal to a diffusion width of the light of the second light diffusion part.

(4) In the structure of any one of above (1) to (3), the intermediate incident surface includes a first arrangement pattern part in which the third light diffusion part and the fourth light diffusion part are arranged substantially alternately in a horizontal direction, a second arrangement pattern part in which substantially only the plain part is arranged in the horizontal direction, and a third arrangement pattern part in which substantially only the fourth light diffusion part is arranged in the horizontal direction, and wherein the intermediate incident surface includes the first arrangement pattern part substantially at a center of the intermediate incident surface in a vertical direction, and toward an outside in the vertical direction, the intermediate incident surface includes sequentially the second arrangement pattern part, the first arrangement pattern part, the third arrangement pattern part, the first arrangement pattern part, the third arrangement pattern part, the first arrangement pattern part, and the second arrangement pattern part, and the intermediate incident surface further includes the third arrangement pattern part on a top outside of the intermediate incident surface in the vertical direction and the first arrangement pattern part on a bottom outside of the intermediate incident surface in the vertical direction.

(5) In the structure of any one of above (1) to (4), the first light diffusion part is arranged on a substantially entire surface of the upper incident surface without any gaps.

(6) In the structure of any one of above (1) to (5), when a widest width of the lower incident surface in the vertical direction is defined as a lower incident surface width, the second light diffusion part is arranged, without any gaps, in an area having a width which is substantially half the lower incident surface width in a direction from the intermediate incident surface toward a vertically lower side, and a remaining area of the lower incident surface is a plain part in which the second light diffusion part is not arranged.

(7) In the structure of any one of above (1) to (5), the second light diffusion part is arranged on a substantially entire surface of the lower incident surface without any gaps.

(8) In the structure of any one of above (1) to (7), the intermediate incident surface is formed so as to position a center of the incident surface at a substantially intermediate part of a width of the intermediate incident surface in the vertical direction, and the width of the intermediate incident surface in the vertical direction is 20% to 45% of a maximum width of an entire incident surface in the vertical direction.

(9) In the structure of any one of above (1) to (8), a reflector that is disposed so as to cover the light source in a half dome shape and reflects light from the light source toward a side of the lens; and a shade that is disposed between the reflector and the lens and blocks a part of light reflected by the reflector are further included.

Effect of the Invention

The present invention can provide the vehicular lighting that prevents light distribution unevenness from being generated on a road surface in view of operability of adjustment by aiming or the like.

BRIEF DESCRIPTION OF THE DRAWINGS

FIG. 1 is a plan view of a vehicle including a vehicular lighting according to an embodiment of the present invention.

FIG. 2 is a cross-sectional view of a lamp unit according to the embodiment of the present invention, taken along a light irradiation optical axis.

FIG. 3 is a perspective view showing a side of an incident surface of a lens according to the embodiment of the present invention.

FIG. 4 is a plan view showing only the incident surface of the lens according to the embodiment of the present invention as viewed from the front.

FIG. 5 show light distribution patterns of the vehicular lighting according to the embodiment of the present invention on a screen. FIG. 5(*a*) shows a light distribution pattern of light entering an upper incident surface of the lens. FIG. 5(*b*) shows a light distribution pattern of light entering an intermediate incident surface of the lens. FIG. 5(*c*) shows a light distribution pattern of light entering a lower incident surface of the lens.

FIG. 5(*d*) shows a low-beam light distribution pattern obtained by multiplexing the light distribution patterns (a) to (c), in the vehicular lighting.

FIG. 6 are explanatory diagrams of a light distribution pattern on the screen formed by light entering the intermediate incident surface of the lens according to the embodiment of the present invention. FIG. 6(*a*) is a comparison diagram in which a third light diffusion part is formed on the entire intermediate incident surface. FIG. 6(*b*) shows a case of the present embodiment.

FIG. 7 is an explanatory diagram of unevenness in luminous intensity, which is similar to the low-beam light distribution pattern shown in FIG. 5(*d*).

FIG. 8 shows a modification of the incident surface of the lens according to the embodiment of the present invention.

MODE FOR CARRYING OUT THE INVENTION

A mode for carrying out the present invention (hereinafter, "embodiment") is described below in detail with reference to the attached drawings. Like element are designated by like numerals throughout the description of the embodiment. In the embodiment and the drawings, "front" and "rear" mean "moving forward direction" of a vehicle and "moving backward direction" of a vehicle, respectively, and "upper", "lower", "left", and "right" are used for directions as viewed from a driver in a vehicle, unless otherwise mentioned.

A vehicular lighting according to an embodiment of the present invention is a vehicular lighting incorporated in each of left and right head lamps for a car (101R, 101L) on the front of a vehicle 102 shown in FIG. 1. Hereinafter, a vehicular lighting for left traveling is described.

The vehicular lighting according to the present embodiment includes a housing (not shown) that is open to a vehicle front side and an outer lens (not shown) that is attached to the housing so as to cover the opening. A lamp unit 10 (see FIG. 2) and the like is disposed in a lamp chamber constituted by the housing and the outer lens.

FIG. 2 is a cross-sectional view of the lamp unit 10, taken along a light irradiation optical axis As shown in FIG. 2, the lamp unit 10 includes a heat sink 20, a light source 30 disposed on the heat sink 20, a reflector 40 that is disposed above the heat sink 20 so as to cover the light source 30 in a half dome shape, a lens 50 that is disposed on a front side of the light source 30, and a shade 60 that is disposed between the reflector 40 and the lens 50.

(Heat Sink)

The heat sink 20 radiates heat generated by the light source 30, and is preferably molded using a metal material (for example, aluminum) or a resin with high thermal conductivity. The heat sink 20 according to the present embodiment is composed of aluminum die cast.

(Light Source)

A semiconductor light source is preferably used as the light source 30. The present embodiment uses an LED, which is a semiconductor light source in which a light-emitting chip 32 is placed on a substrate 31 having electric wiring for power supply (not shown) formed thereon.

The number of the light-emitting chips 32 placed on the substrate 31 is not particularly limited, and one or a plurality of the light-emitting chips 32 may be placed.

In addition, the shape of the light-emitting chip 32 is not particularly limited, and a square or rectangular light-emitting chip 32 may be used.

While the present embodiment describes the case of using an LED, semiconductor light sources such as an LD and an EL (an organic EL) may be used.

As shown in FIG. 2, in the present embodiment, the substrate 31 is disposed on the heat sink 20 so that a light-emitting surface of the light-emitting chip 32 faces upward, and light from the light source 30 is irradiated upward.

(Reflector)

The reflector 40 is disposed above the heat sink 20 so as to cover the light source 30 in a half dome shape, and light from the light source 30 is reflected toward a side of the lens 50 by a reflecting surface 41 of the reflector 40.

A material used for the reflector 40 is preferably a metal material (for example, aluminum) or a resin material with high thermal conductivity, and at the same time, a light impermeable material. For example, the reflector 40 may be composed of aluminum die cast, similarly to the heat sink 20.

The reflecting surface 41 of the reflector 40 is formed of a free curved surface based on a spheroid (an ellipse) having two focuses.

The reflector 40 is disposed above the heat sink 20 so that a first focus F1 of the reflecting surface 41 is positioned at or near the light-emitting center of the light source 30 and a second focus F2 is positioned near an upper end of the shade 60.

(Lens)

The lens 50 may be composed of a transparent resin material such as polycarbonate and acryl.

While an aspheric lens that is circular as viewed from the front in a light irradiation direction, and includes, as shown in FIG. 2, a light incident surface 51 that is flat and a light-emitting surface 52 that has an arc shape projecting toward the front side is used as the lens 50 in the present embodiment, for example, the surface shape of the incident surface 51 or the light-emitting surface 52 may be formed in other shapes including a free curved surface.

While the incident surface 51 of the lens 50 has a flat appearance as described above, light diffusion parts (prisms) are formed on the incident surface 51.

Precisely, a large number of minute projections are formed on the incident surface 51 and thus the incident surface 51 is not completely flat. The light diffusion part is described later in detail.

The lens 50 includes a flange 53 on a side of the incident surface 51. For example, the flange 53 is held by a lens holder (not shown) attached to the heat sink 20, and the lens 50 is disposed so that a back focus of the lens 50 is positioned at or near the second focus F2 of the reflector 40.

(Shade)

The shade 60 is preferably composed of a light impermeable material, and is attached to the heat sink 20 so that, as shown in FIG. 2, the upper end of the shade 60 is positioned near the second focus F of the reflector 40 and near the back focus of the lens 50.

A part of light reflected by the reflecting surface 41 of the reflector 40 toward the side of the lens 50 is blocked, so that a cut-off line CL of a light distribution pattern LP is formed.

Next, the light diffusion part formed on the incident surface 51 of the lens 50 is described with reference to FIG. 3.

FIG. 3 is a perspective view showing the side of the incident surface 51 of the lens 50.

In FIG. 3, the light diffusion part on the incident surface 51 is omitted, and only areas on the incident surface 51 classified by the light diffusion part are shown.

As shown in FIG. 3, the lens 50 an upper incident surface 54 above the center of the incident surface 51, an intermediate incident surface 55 including the center of the incident surface 51, and a lower incident surface 56 under the intermediate incident surface 55.

FIG. 4 is a plan view showing only the incident surface 51 as viewed from the front.

As shown in FIG. 4, first light diffusion parts 54*a* diffusing light are arranged on the upper incident surface 54 and second light diffusion parts 56*b* diffusing light are arranged on the lower incident surface 56.

Third light diffusion parts 55*b* and fourth light diffusion parts 55*a* that diffuse light are arranged on the intermediate incident surface 55. The intermediate incident surface 55 also includes a plain part 55*c* in which the third light diffusion part 55*b* and the fourth light diffusion part 55*a* are not arranged.

The intermediate incident surface 55 is described in further detail. As shown by (1), (2), and (3) on the right side of FIG. 4, the intermediate incident surface 55 includes a first arrangement pattern part (1) in which the third light diffusion part 55*b* and the fourth light diffusion part 55*a* are arranged substantially alternately in a horizontal direction (a left-and-right direction in the drawing), a second arrangement pattern part (2) in which almost only the plain parts 55*c* are arranged in the horizontal direction, and a third arrangement pattern part (3) in which almost only the fourth light diffusion parts 55*a* are arranged in the horizontal direction.

As shown by (1), (2), and (3) on the left side of FIG. 4, the intermediate incident surface 55 includes the first arrangement pattern part (1) (see framed (1)) substantially at the center of the intermediate incident surface 55 in a vertical direction (a vertical direction in the drawing), and toward the outside in the vertical direction (the vertically outside in the drawing), the intermediate incident surface 55 includes sequentially the second arrangement pattern part (2), the first arrangement pattern part (1), the third arrangement pattern part (3), the first arrangement pattern part (1), the third arrangement pattern part (3), the first arrangement pattern part (1), and the second arrangement pattern part (2).

Moreover, the third arrangement pattern part (3) is formed on the top outside (the top in the drawing) of the intermediate incident surface 55 in the vertical direction (the vertical direction in the drawing), and the first arrangement pattern part (1) is formed on the bottom outside (the bottom in the drawing) of the intermediate incident surface 55 in the vertical direction.

On the intermediate incident surface 55 having the third light diffusion part 55*b*, the fourth light diffusion part 55*a*, and the plain part 55*c* arranged thereon, the third light diffusion parts 55*b* are formed to be arranged in a substantially evenly distributed manner, the fourth light diffusion parts 55*a* are formed without any unevenness as a whole, and similarly, the plain parts 55*c* are formed without any unevenness as a whole.

The third light diffusion part 55*b*, the fourth light diffusion part 55*a*, and the plain part 55*c* are arranged on the intermediate incident surface 55 without any unevenness. Consequently, if the attachment position of the lens 50 is slightly shifted by an attachment error at the time of assemble or the like, a light diffusion state does not change.

For this reason, the intermediate incident surface 55 can achieve a stable light diffusion state.

While the arrangement state of the third light diffusion part 55*b*, the fourth light diffusion part 55*a*, and the plain part 55*c* has been described above in detail, this is an example of good arrangements, and it is not necessary to have such a fine arrangement. The intermediate incident surface 55 can similarly achieve the stable light diffusion state as long as the third light diffusion part 55*b*, the fourth light diffusion part 55*a*, and the plain part 55*c* are arranged on the intermediate incident surface 55 without excessive unevenness.

The first light diffusion parts 54*a* are evenly arranged on the substantially entire upper incident surface 54 and the second light diffusion parts 56*b* are also arranged evenly on the substantially entire lower incident surface 56. Consequently, if the attachment position of the lens 50 is slightly shifted by an attachment error at the time of assemble or the like, the light diffusion state of the upper incident surface 54 and the lower incident surface 56 does not change, as in the intermediate incident surface 55.

Similarly to the intermediate incident surface 55, the upper incident surface 54 and the lower incident surface 56 can achieve the stable light diffusion state.

In the present embodiment, the first light diffusion part 54*a*, the second light diffusion part 56*b*, the third light diffusion part 55*b*, and the fourth light diffusion part 55*a* have the same shape.

Specifically, the first light diffusion part 54*a*, the second light diffusion part 56*b*, the third light diffusion part 55*b*, and the fourth light diffusion part 55*a* are a prism that is a rhombus pyramid having a rhombic bottom surface and projecting in a direction away from the incident surface 51 (toward the side of the light source 30).

For the fourth light diffusion part 55*a*, the rhombus pyramid has a height (projection) of 10 μm. Similarly, for the first light diffusion part 54*a*, the rhombus pyramid has a height (projection) of 10 μm.

The diffusion width of light varies depending on the height (the projection) of a rhombus pyramid. The diffusion width of light in the first light diffusion part 54*a* is thus substantially equal to the diffusion width of light in the fourth light diffusion part 55*a*.

For the third light diffusion part 55*b*, the rhombus pyramid has a height (projection) of 20 μm. Similarly, for the second light diffusion part 56*b*, the rhombus pyramid has a height (projection) of 20 μm.

The diffusion width of light in the third light diffusion part 55*b* is thus substantially equal to the diffusion width of light in the second light diffusion part 56*b*.

As described above, the intermediate incident surface 55 includes the plain part 55*c* in which the light diffusion part (the third light diffusion part 55*b* or the fourth light diffusion part 55*a*) is not arranged, and thus light entering the lens 50 from the plain part 55*c* is not diffused.

For this reason, the amount of dimming in a light distribution pattern formed by light entering the intermediate incident surface 55 is less than that in a case where light diffusion parts are formed on the entire intermediate incident surface 55 without any gaps.

Meanwhile, light entering the lens 50 from a part in which the light diffusion part (the third light diffusion part 55*b* or the fourth light diffusion part 55*a*) is arranged is diffused based on the diffusion width of that light diffusion part.

That is, when light enters the lens 50, light entering from a part in which the third light diffusion part 55*b* having a large diffusion width of light is arranged enters the lens 50 with a large diffusion width, whereas light entering from a part in which the fourth light diffusion part 55*a* having a small diffusion width of light is arranged enters the lens 50 with a small diffusion width.

Next, a light distribution pattern in the vehicular lighting having the configuration described above is described below.

FIG. 5 show light distribution patterns on a screen. FIG. 5(*a*) shows a light distribution pattern P1 of light entering the upper incident surface 54. FIG. 5(*b*) shows a light distribution pattern P2 of light entering the intermediate incident surface 55. FIG. 5(*c*) shows a light distribution pattern P3 of light entering the lower incident surface 56. FIG. 5(*d*) shows a low-beam light distribution pattern LP obtained by multiplexing the light distribution patterns P1, P2, and P3.

As can be seen from FIG. 5, light entering the upper incident surface 54 (see FIG. 5(*a*)) and the lower incident surface 56 (see FIG. 5(*c*)) forms a diffused light distribution pattern in a low-beam light distribution pattern. Light entering the intermediate incident surface 55 (see FIG. 5(*b*)) forms a collected light distribution pattern in a low-beam light distribution pattern, including an upper cut-off line CL1, a diagonal cut-off line CL2, and a lower cut-off line CL3.

Hereinafter, the upper cut-off line CL1, the diagonal cut-off line CL2, and the lower cut-off line CL3 are collectively referred to as a cut-off line CL.

As described above, the intermediate incident surface 55 includes the plain part 55*c* and light entering the lens 50 from the plain part 55*c* is not diffused. It is thus possible to reduce the amount of dimming in a light distribution pattern, and as described below with reference to FIG. 6, the cut-off line CL can be easily viewed.

FIG. 6 are partial enlarged views of the cut-off line CL of a light distribution pattern on a screen formed by light entering the intermediate incident surface 55. FIG. 6(*a*) is a comparison diagram in which light diffusion parts identical to the third light diffusion parts 55*b* are arranged on the entire intermediate incident surface 55 without any gaps. FIG. 6(*b*) shows a case of the present embodiment.

In both cases of FIGS. 6(*a*) and 6(*b*), the light diffusion part is formed on the intermediate incident surface 55. Light diffused by the light diffusion part is thus irradiated above the upper cut-off line CL1, the diagonal cut-off line CL2, and the lower cut-off line CL3, and light distribution expands over the range indicated by an one-dot chain line SL.

It is thus possible to prevent light from suddenly becoming dark after crossing the cut-off line CL, which gives good visibility to a driver.

However, when the plain part 55*c* is formed on the intermediate incident surface 55 as in the present embodiment, the amount of dimming in the light distribution pattern is reduced accordingly. Consequently, the amount of dimming of the cut-off line CL is reduced and the cut-off line CL of FIG. 6(*b*) is brighter than that of FIG. 6(*a*).

It is easy to view the cut-off line CL and thus it is possible to improve operability in adjustment by aiming or the like.

In addition, as described above, not only the plain part 55*c* is arranged but also the third light diffusion part 55*b* having a large diffusion width of light and the fourth light diffusion part 55*a* having a small diffusion of light are arranged in a mixed manner in the light diffusion part in the present embodiment.

Light diffused by the fourth light diffusion part 55*a* having a small diffusion of light is irradiated on a position indicated by a dot line SLM between the cut-off line CL and the one-dot chain line SL, which is a good state where the amount of light is gradually reduced from the cut-off line CL toward the one-dot chain line SL.

While the maximum width of each of the upper incident surface 54, the intermediate incident surface 55, and the lower incident surface 56 shown in FIG. 3 in the vertical direction (the vertical direction in the drawing) is ⅓ of the maximum width of the incident surface 51 in the vertical direction in the present embodiment, it is not necessary to have an equal width. It is only required that the intermediate incident surface 55 has a width that enables a part of the incident surface 51 where light mainly forming the cut-off line CL enters to be covered.

It is thus preferable to set the intermediate incident surface 55 in a manner that the width (the maximum width) of the intermediate incident surface 55 in the vertical direction (the vertical direction in the drawing) is 20% to 45% of the maximum width of the incident surface 51 in the vertical direction, and the substantially intermediate (the substantially center) part of the width of the intermediate incident surface 55 in the vertical direction is positioned at the center of the incident surface 51.

While the light diffusion part (the first light diffusion part 54*a*, the second light diffusion part 56*b*, the third light diffusion part 55*b*, and the fourth light diffusion part 55*a*) is a prism that is a rhombus pyramid having a rhombic bottom surface in the embodiment described above, it is not necessary to have a rhombic bottom surface. A prism such as a right square pyramid having a square bottom surface may be used, and the shape of the prism may be changed as needed.

The height (the projection) of the light diffusion part (the first light diffusion part 54*a*, the second light diffusion part 56*b*, the third light diffusion part 55*b*, and the fourth light diffusion part 55*a*) does not need to be limited to the height specifically mentioned above.

As described above, when the height (the projection) of the light diffusion part (the first light diffusion part 54*a*, the second light diffusion part 56*b*, the third light diffusion part 55*b*, and the fourth light diffusion part 55*a*) is increased, the diffusion width of light is increased. On the other hand, when the height (the projection) is reduced, the diffusion width of light is reduced. Consequently, the height (the projection) of the light diffusion part (the first light diffusion part 54*a*, the second light diffusion part 56*b*, the third light diffusion part 55*b*, and the fourth light diffusion part 55*a*) may be adjusted to be suitable for a required degree of dimming of light distribution.

Direct light from the light source 30 also enters the upper incident surface 54. When direct light is diffused by a light diffusion part having a large diffusion width of light, shadows by diffusion of light (shadows of a prism) are sometimes made on a road surface. The height (the protrusion) of the first light diffusion part 54*a* is preferably lower than or equal to 10 μm.

(Modification)

FIG. 7 shows the low-beam light distribution pattern LP shown in FIG. 5(*d*), that is, shows a light distribution pattern of the vehicular lighting according to the embodiment described above.

As can be seen from a light beam L1 shown in FIG. 2, light passing through the lower side of the lens 50 is distributed downward, and thus is irradiated to the lower side of the low-beam light distribution pattern LP.

This means that light entering from the lower side of the lower incident surface 56 where light passing through the lower side of the lens 50 enters forms the lower side of the low-beam light distribution pattern LP.

The second light diffusion parts 56*b* are evenly formed on the substantially entire lower incident surface 56 in the embodiment described above, and thus light irradiated to the lower side of the low-beam light distribution pattern LP is also diffused.

The lower side of the low-beam light distribution pattern LP is a light distribution part irradiating the vicinity of the vehicle 102. Consequently, if a group of light beams to be irradiated has unevenness in luminous intensity, such unevenness in luminous intensity easily appears. As a result, unevenness in luminous intensity based on light diffusion by the second light diffusion part 56*b* may be generated in the lower side of the low-beam light distribution pattern LP such as an area A circled by a dot line in FIG. 7.

To prevent such unevenness in luminous intensity, the second light diffusion parts 56*b* are not preferably arranged in the lower portion of the lower incident surface 56.

FIG. 8 shows a modification of the incident surface 51 of the lens 50, specifically, a case where the second light diffusion parts 56*b* are not arranged in the lower portion of the lower incident surface 56.

As shown in FIG. 8, when the widest width of the lower incident surface 56 in the vertical direction (the vertical direction in the drawing) is defined as a lower incident surface width, the second light diffusion parts 56*b* are arranged, without any gaps, in an area having a width which is half the lower incident surface width in a direction from the intermediate incident surface 55 toward a vertically lower side (a lower side in the drawing). The remaining area of the lower incident surface 56 is the plain part 56*c* in which the second light diffusion parts 56*b* are not arranged.

As described above, the lower portion of the lower incident surface 56 is the plain part 56*c*, and thus light entering the lens 50 from the plain part 56*c* is not diffused and it is possible to prevent unevenness in luminous intensity based on light diffusion from being generated.

Consequently, it is possible to form the low-beam light distribution pattern LP without any unevenness in luminous intensity on the lower side of the low-beam light distribution pattern LP.

While the present invention has been described above based on the specific embodiment, the present invention is not limited to the embodiment described above.

For example, while the embodiment has been described by taking a vehicular lighting for left travelling as an example, a vehicular lighting for right travelling can achieve similar effects when a light diffusion part is formed on an incident surface of a lens as described above. Consequently, the present invention is not limited to the vehicular lighting for left travelling.

As described above, the present invention is not limited to the embodiment. Alterations and improvements without departing from the technical spirit are also included in the technical scope of the invention, which is apparent to a person skilled in the art from the description of the claims.

DESCRIPTION OF REFERENCE NUMERALS

10: Lamp unit
20: Heat sink
30: Light source
31: Substrate
32: Light-emitting chip
40: Reflector
41: Reflecting surface
50: Lens
51: Incident surface
52: Light-emitting surface
53: Flange
54: Upper incident surface
54*a*: First light diffusion part
55: Intermediate incident surface
55*a*: Fourth light diffusion part
55*b*: Third light diffusion part
55*c*: Plain part
56: Lower incident surface
56*b*: Second light diffusion part
56*c*: Plain part
60: Shade
CL: Cut-off line
CL1: Upper cut-off line
CL2: Diagonal cut-off line
CL3: Lower cut-off line
F1: First focus
F2: Second focus
L1: Light beam
LP: Low-beam light distribution pattern
P1, P3: Diffused light distribution pattern
P2: Collected light distribution pattern
101L, 101R: Head lamp for a car
102: Vehicle

The invention claimed is:

1. A vehicular lighting comprising:

a light source; and a lens disposed on a front side of the light source, the vehicular lighting forming light distribution having a cut-off line, wherein an incident surface of the lens that light from the light source enters includes an upper incident surface above a center of the incident surface, on which a first light diffusion part diffusing the light is arranged, a lower incident surface below the center of the incident surface, on which a second light diffusion part diffusing the light is arranged, and an intermediate incident surface including the center of the incident surface, on which a third light diffusion part and a fourth light diffusion part that diffuse the light are arranged, the intermediate incident surface having a plain part in which the third light diffusion part and the fourth light diffusion part are not arranged, and wherein a diffusion width of the light of the third light diffusion part is larger than a diffusion width of the light of the fourth light diffusion part.

2. The vehicular lighting according to claim 1, wherein a diffusion width of the light of the first light diffusion part is substantially equal to the diffusion width of the light of the fourth light diffusion part.

3. The vehicular lighting according to claim 1, wherein the diffusion width of the light of the third light diffusion part is substantially equal to a diffusion width of the light of the second light diffusion part.

4. The vehicular lighting according to claim 1, wherein the intermediate incident surface includes a first arrangement pattern part in which the third light diffusion part and the fourth light diffusion part are arranged substantially alternately in a horizontal direction, a second arrangement pattern part in which substantially only the plain part is arranged in the horizontal direction, and a third arrangement pattern part in which substantially only the fourth light diffusion part is arranged in the horizontal direction, and wherein the intermediate incident surface includes the first arrangement pattern part substantially at a center of the intermediate incident surface in a vertical direction, and toward an outside in the vertical direction, the intermediate incident surface includes sequentially the second arrangement pattern part, the first arrangement pattern part, the third arrangement pattern part, the first arrangement pattern part, the third arrangement pattern part, the first arrangement pattern part, and the second arrangement pattern part, and the intermediate incident surface further includes the third arrangement pattern part on a top outside of the intermediate incident surface in the vertical direction and the first arrangement pattern part on a bottom outside of the intermediate incident surface in the vertical direction.

5. The vehicular lighting according to claim 1, wherein the first light diffusion part is arranged on a substantially entire surface of the upper incident surface without any gaps.

6. The vehicular lighting according to claim 1, wherein when a widest width of the lower incident surface in the vertical direction is defined as a lower incident surface width, the second light diffusion part is arranged, without any gaps, in an area having a width which is substantially half the lower incident surface width in a direction from the intermediate incident surface toward a vertically lower side, and a remaining area of the lower incident surface is a plain part in which the second light diffusion part is not arranged.

7. The vehicular lighting according to claim 1, wherein the second light diffusion part is arranged on a substantially entire surface of the lower incident surface without any gaps.

8. The vehicular lighting according to claim 1, wherein the intermediate incident surface is formed so as to position a center of the incident surface at a substantially intermediate part of a width of the intermediate incident surface in the vertical direction, and the width of the intermediate incident surface in the vertical direction is 20% to 45% of a maximum width of an entire incident surface in the vertical direction.

9. The vehicular lighting according to claim 1, further comprising:

a reflector that is disposed so as to cover the light source in a half dome shape and reflects light from the light source toward a side of the lens; and a shade that is disposed between the reflector and the lens and blocks a part of light reflected by the reflector.

* * * * *